US007874868B2

(12) United States Patent
Chang

(10) Patent No.: US 7,874,868 B2
(45) Date of Patent: Jan. 25, 2011

(54) CONNECTOR WITH PROJECTING FUNCTION

(76) Inventor: Nai- Chien Chang, 5F., No. 15, Lane 117, Sec. 4, Sanhe Rd., Sanchong City, Taipei County 241 (TW)

( * ) Notice: Subject to any disclaimer, the term of this patent is extended or adjusted under 35 U.S.C. 154(b) by 0 days.

(21) Appl. No.: 12/710,416

(22) Filed: Feb. 23, 2010

(65) Prior Publication Data

US 2010/0240257 A1 Sep. 23, 2010

(30) Foreign Application Priority Data

Mar. 18, 2009 (TW) ..... 98204269 U

(51) Int. Cl.
*H01R 13/60* (2006.01)

(52) U.S. Cl. ..... 439/540.1; 439/607.1; 439/541.5

(58) Field of Classification Search ..... 439/607.1, 439/607.9, 607.23, 607.25, 607.35, 607.55, 439/540.1, 541.5, 489–490
See application file for complete search history.

(56) References Cited

U.S. PATENT DOCUMENTS 6,162,089 A * 12/2000 Costello et al. ..... 439/541.5
6,224,417 B1 * 5/2001 Belopolsky et al. ..... 439/490
6,428,361 B1 * 8/2002 Imschweiler et al. ..... 439/490
6,540,563 B1 * 4/2003 Hu et al. ..... 439/607.23
6,688,908 B2 * 2/2004 Wallace ..... 439/490
6,755,685 B1 * 6/2004 Espenshade ..... 439/541.5
6,786,772 B1 * 9/2004 Liu ..... 439/541.5
7,556,528 B1 * 7/2009 Ju ..... 439/541.5
7,588,458 B2 * 9/2009 He et al. ..... 439/541.5
7,651,370 B2 * 1/2010 Chuang ..... 439/540.1
7,677,925 B2 * 3/2010 Chuang ..... 439/607.25
2009/0215308 A1 * 8/2009 Wu ..... 439/490
2009/0318015 A1 * 12/2009 Slepov ..... 439/490

* cited by examiner

*Primary Examiner*—Briggitte R Hammond
(74) *Attorney, Agent, or Firm*—Chun-Ming Shih; HDLS IPR Services

(57) ABSTRACT

A connector with projecting function is electrically connected to a circuit board of an electronic device and includes a casing, a base, a rear cover, a projecting module and an electrical connector. The base has a first port and a second port. The projecting module is provided in the first port. The electrical connector is provided in the second port. The casing and the rear cover are assembled outside the base. When the connector is combined with the electronic device, a plurality of electrical-conductive terminals of the connector is configured to transmit image signals of the electronic device to a circuit board of the connector. Then, a control circuit and an image processing chip of the projecting module can process the image signals to project the processed images onto an external screen.

6 Claims, 4 Drawing Sheets

CONNECTOR WITH PROJECTING FUNCTION

BACKGROUND OF THE INVENTION

1. Field of the Invention

The present invention relates to a connector, and in particular to a connector with projecting function.

2. Description of Prior Art

Electrical connector means an element and its associated accessory used for the electrical connection of electronic signals and a power source. For example, a connector has to be provided between a computer and its peripheral device such as a mouse, display, keyboard, printer or the like. On the other hand, the electrical connection of the respective modules in a device also relies on a connector. Thus, connectors have become important elements for electronic products.

With the advancement of science and technology, many new-generation electrical connectors are developed, such as USB, HDMI, Displayport, eSATA, and SATA. Among these electrical connectors, some of them are configured to reduce the number of transmission lines and increase the transmission efficiency. For example, when a traditional electrical connector is used to transmit audio and video signals, it needs at least three transmission lines. However, nowadays, only one HDMI transmission line is enough to transmit audio and video signals simultaneously. Alternatively, a multi-port electrical connector is proposed, in which several electrical sub-connectors with different functions are overlapped or combined with each other. Such a multi-port electrical connector allows different transmission lines to be inserted therein. In fact, the above-mentioned electrical connectors only aim to simplify the number of transmission lines, increase the transmission efficiency, and allow several transmission lines to be inserted therein.

However, the above-mentioned electrical connectors can only be used for the signal transmission. If the electrical connector has a further function in addition to the signal transmission, it would become a multiple-purpose electrical connector.

SUMMARY OF THE INVENTION

The present invention is to provide a connector with projecting function, in which a projecting module is provided. When the connector is combined with an electronic device, a display originally provided in the electronic device can be used to play images. In addition, the projecting module can be also used to project images on an external screen.

The present invention is to provide a connector with projecting function, electrically connected to an electronic device and including:

a casing having a front decorative plate, both sides of the front decorative plate extending to form two side plates symmetrical to each other, an upper edge of the front decorative plate having a folded plate bent between the two side plates, the front decorative plate having a plurality of openings;

a base provided in the casing, a font end of the base being provided with a first port and a second port corresponding to the plurality of openings;

a rear cover provided at a rear end of the base, the rear cover being assembled with the casing to cover outside the base;

a projecting module constituted of a circuit board and a lens, the circuit board having an image processing chip, a control circuit, and a plurality of electrical-conductive terminals; and an electrical connector provided in the second port;

wherein image signals of the electrical device can be transmitted to the circuit board via the plurality of electrical-conductive terminals, the control circuit and the image processing chip process the image signals, and the processed images are projected onto an external screen by the lens.

DETAILED DESCRIPTION OF THE INVENTION

The characteristics and technical contents of the present invention will be described with reference to the accompanying drawings.

Figure 1:
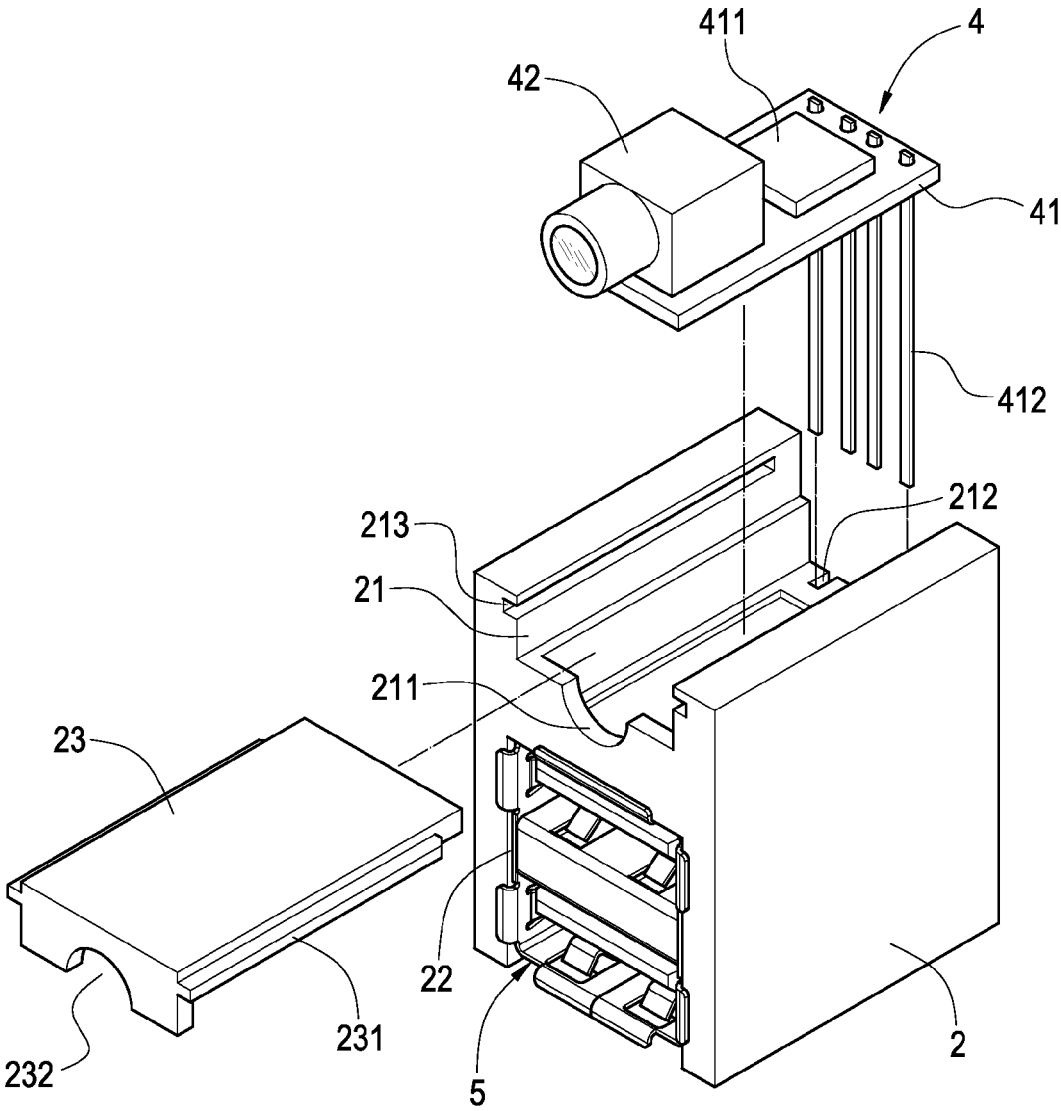
FIG. 1 is an exploded view showing the projecting module and the base of the present invention.
Figure 2:
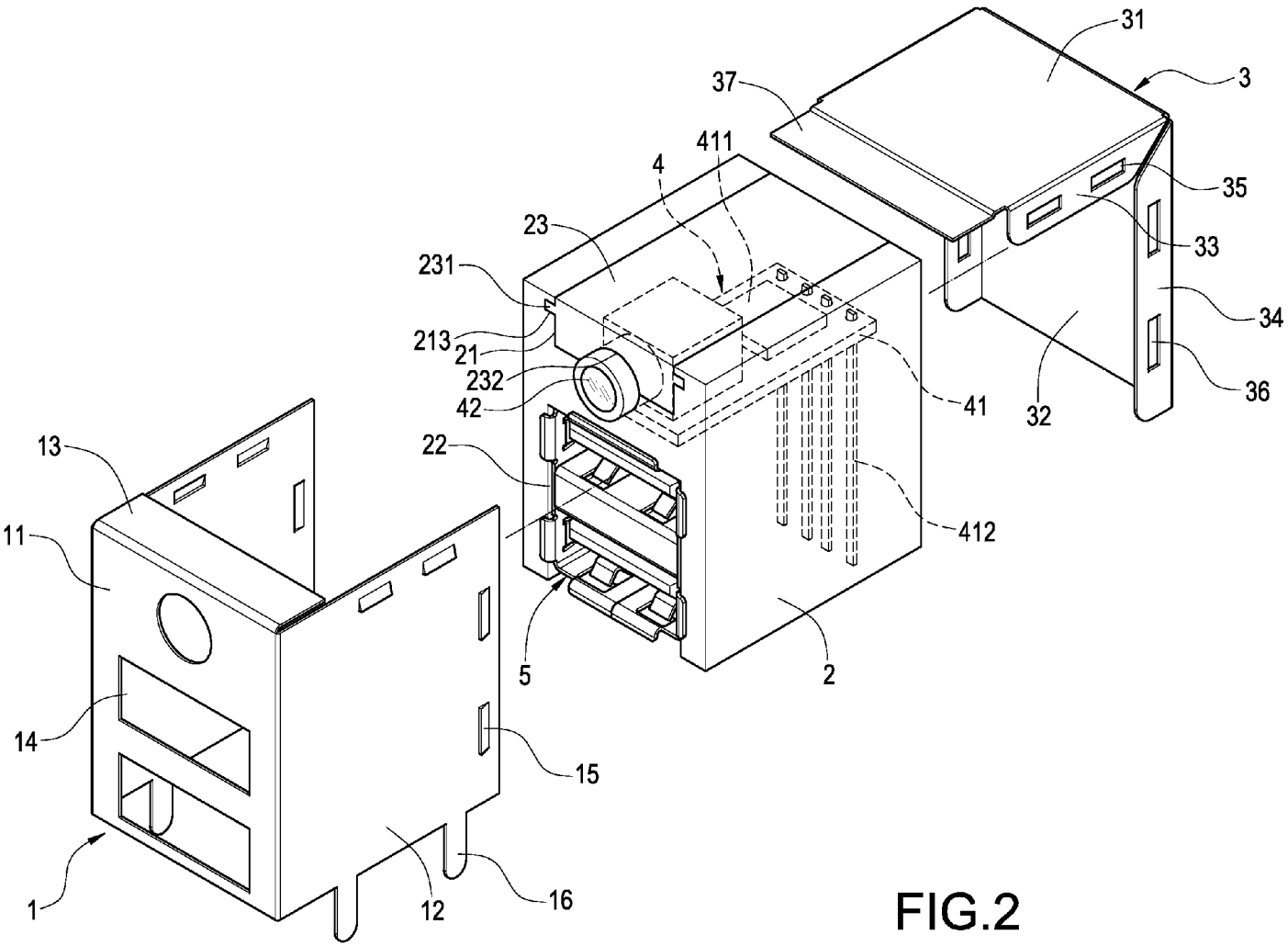
FIG. 2 is an exploded view showing the base and the casing of the present invention.
Figure 3:
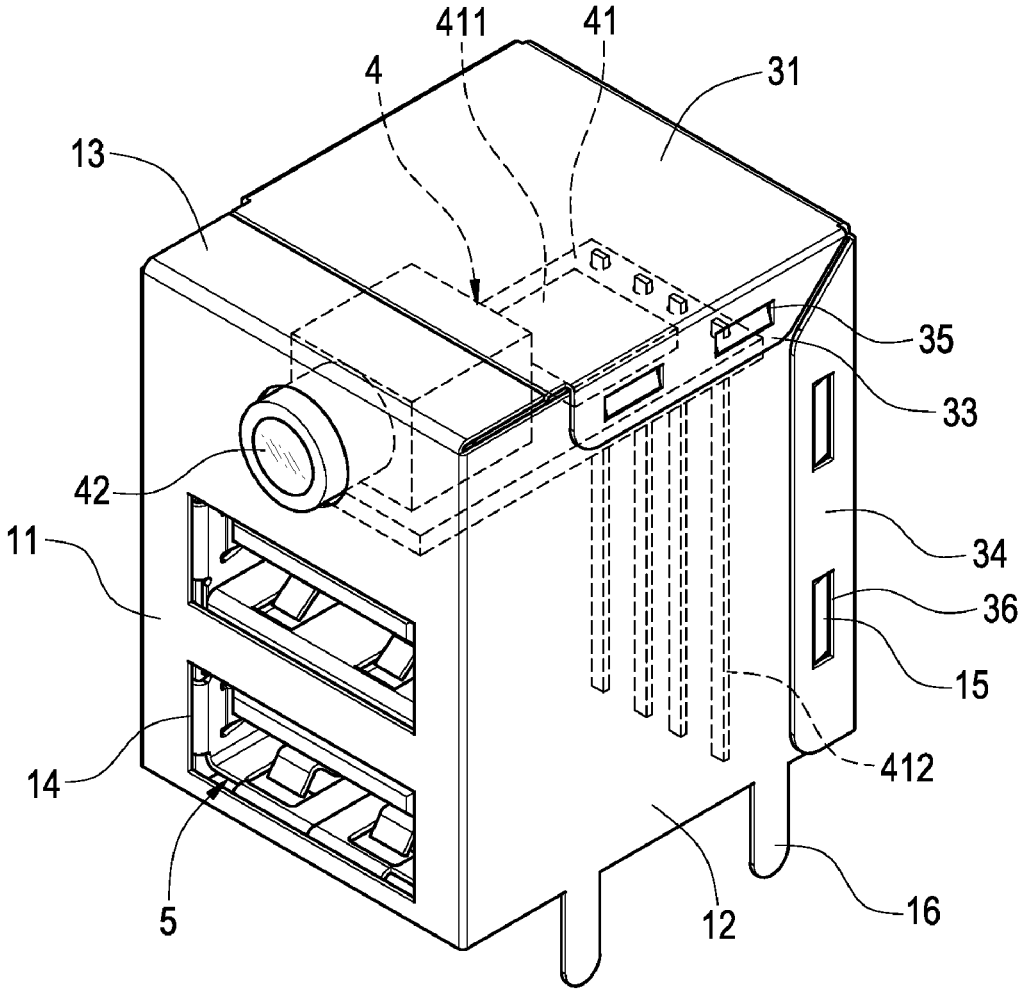
FIG. 3 is an assembled view showing the external appearance of the present invention.

Please refer to FIGS. 1 to 3. FIG. 1 is an exploded view showing the projecting module and the base of the present invention. FIG. 2 is an exploded view showing the base and the casing of the present invention. FIG. 3 is an assembled view showing the external appearance of the present invention. The present invention provides a connector with projecting function, which includes a casing 1, a base 2, a rear cover 3, and a projecting module 4.

The casing 1 is made of a metallic material with a U shape. The casing 1 has a front decorative plate 11. Both sides of the front decorative plate 11 extend to form two side plates 12 symmetrical to each other. The upper edge of the front decorative plate 11 has a folded plate 13 bent between the two side plates 12. The front decorative plate 11 has a plurality of openings 14. The side plate 12 has a plurality of connecting blocks 15. The lower edge of the side plate 12 extends to form a plurality of fixing legs 16 for fixing a mother board of an electronic device (not shown).

The base 2 is disposed in the casing 1. The base 2 has a first port 21, a second port 22, and a sliding cover 23. The front end of the first port 21 has a semi-circular notch 211, and the rear end of the first port 21 has a plurality of troughs 212. Both side walls in the first port 21 are provided with two grooves 213 opposite to each other. After rails 231 provided on both sides of the sliding cover 23 are inserted into the grooves 213 respectively, the sliding cover 23 is connected above the first port 21. The front end of the sliding cover 23 has a semi-conductor notch 232. When the projecting module 4 is disposed in the first port 21, the notches 211, 232 respectively provided on the front ends of the sliding cover 23 and the first port 21 co-operate to sandwich the lens 42 of the projecting module 4 in such a manner that the lens 42 is exposed to the outside.

The rear cover 3 has a top plate 31 and a rear plate 32. Both sides of the top plate 31 and the rear plate 32 are respectively provided with two connecting portions 33 and 34 that are symmetrical to each other. The connecting portions 33 and 34 have connecting holes 35, 36 for allowing the connecting blocks 15 to be inserted therein. The front end of the top plate 31 has a tongue piece 37 inserted into the folded plate 13. The rear cover 3 and the casing 1 are assembled together to cover the outside of the base 2, thereby forming a metallic shroud for preventing the electro-magnetic interference.

The projecting module 4 is constituted of a circuit board 41 and a lens 42. The circuit board 41 has an image processing chip 411, a control circuit (not shown) and a plurality of electrical-conductive terminals 412 inserted into the troughs 212. The plurality of electrical-conductive terminals 412 is configured to transmit image signals to the circuit board 41. After the image signals are processed by the control circuit and the image processing chip 411, the processed images can be projected on an external screen by means of the lens 42.

The electrical connector 5 is provided in the second port 22. The electrical connector 5 may be any one chosen from the group consisting of USB, HDMI, Displayport, PS/2, eSATA, micro-USB, MINI USB, and IEEE1394. The electrical connector 5 is formed by overlapping a plurality of sub-connectors or arranging the sub-connectors in parallel to each other.

Figure 4:
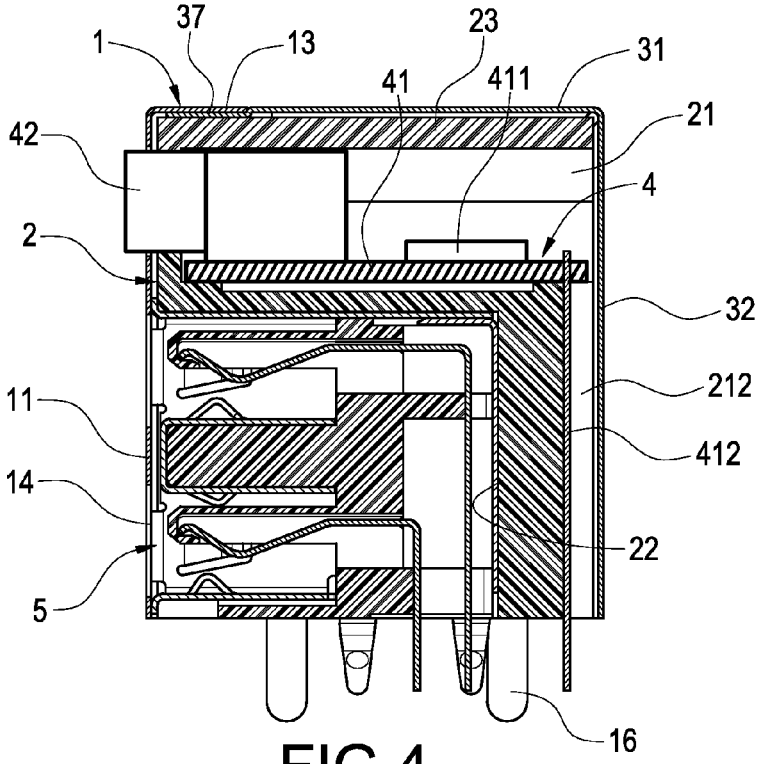
FIG. 4 is an assembled cross-sectional view showing the connector of the present.

Please refer to FIG. 4, which is an assembled cross-sectional view showing the connector of the present. As shown in this figure, after the connector and the projecting module 4 are assembled with each other, the image signals to be played by a user can be transmitted to the projecting module 4 in the first port 21. After the image signals are processed by the circuit board 41, the processed images can be projected to the external screen by means of the lens 42. Further, the electrical connector 5 located below the projecting module 4 allows a or more transmission lines to be inserted therein.

Figure 5:
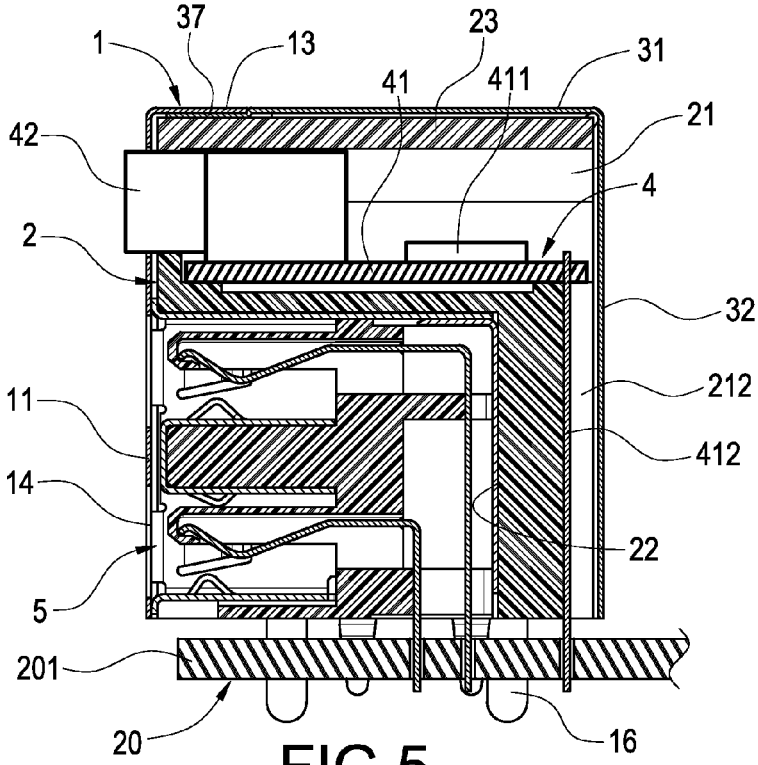
FIG. 5 is a cross-sectional schematic view showing the electrical connection between the connector and an electronic device.

Please refer to FIG. 5, which is a cross-sectional schematic view showing the electrical connection between the connector and an electronic device. As shown in this figure, after the electrical connector of the present invention is electrically connected to a mother board 201 of an electronic device 20, the electronic device 20 can play the images by means of a display (not shown) originally provided therein. In addition, the projecting module 4 of the connector can be used to project the images to the external screen.

Although the present invention has been described with reference to the foregoing preferred embodiment, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A connector with projecting function, electrically connected to a circuit board of an electronic device and including:

a base having a first port and a second port;

a projecting module provided in the first port; and an electrical connector provided in the second port, wherein a front end of the first port of the base has a semi-circular notch, a rear end of the first port of the base has a plurality of troughs, and both side walls inside the base are provided with two grooves opposite to each other; and wherein the first port is further assembled with a sliding cover, both sides of the sliding cover are provided with a rail inserted into the grooves respectively, the sliding cover is assembled above the first port, and a front end of the sliding cover has another semi-circular notch.

2. The connector with projecting function according to claim 1, further including a casing made of a metallic material with a U shape, the casing having a front decorative plate, both sides of the front decorative plate extending to have two side plates symmetrical to each other respectively, an upper edge of the front decorative plate having a folded plate bent between the two side plates, the front decorative plate having a plurality of openings, the side plate having a plurality of connecting blocks, and a lower edge of the side plate extending to form a plurality of fixing legs.

3. The connector with projecting function according to claim 1, wherein the electrical connector is any one chosen from the group consisting of USB, HDMI, Displayport, PS/2, micro-USB, MINI USB, and IEEE1394.

4. The connector with projecting function according to claim 1, wherein the electrical connector is made by overlapping a plurality of sub-connectors or arranging a plurality of sub-connectors in parallel to each other.

5. The connector with projecting function according to claim 1, wherein the projecting module includes a circuit board and a lens, the circuit board is electrically connected to the lens, and the lens is sandwiched between the two semi-circular notches respectively provided at the front ends of the base and the sliding cover.

6. The connector with projecting function according to claim 5, wherein the circuit board has an image processing chip and a control circuit.

* * * * *